US005778294A

United States Patent [19]

Hiraoka et al.

[11] Patent Number: 5,778,294

[45] Date of Patent: Jul. 7, 1998

[54] ELECTROPHOTOGRAPHIC APPARATUS AND BELT FIXING DEVICE WITH NON-UNIFORM NIP PRESSURE

[75] Inventors: Chikara Hiraoka, Chiyoda-machi; Junichi Matsuno, Tsuchiura; Hiromitsu Fukuda, Chiyoda-machi, all of Japan

[73] Assignee: Hitachi, Ltd., Tokyo, Japan

[21] Appl. No.: 710,507

[22] Filed: Sep. 18, 1996

[30] Foreign Application Priority Data

Sep. 20, 1995 [JP] Japan ..... 7-241243

[51] Int. Cl.[6] ..... G03G 15/20

[52] U.S. Cl. ..... 399/329

[58] Field of Search ..... 399/329, 328

[56] References Cited

U.S. PATENT DOCUMENTS

| | | | |
|---|---|---|---|
| 5,343,280 | 8/1994 | Hirabayashi et al. | 399/329 X |
| 5,345,300 | 9/1994 | Uehara et al. | 399/329 |
| 5,349,424 | 9/1994 | Dalal et al. | 399/329 |
| 5,410,394 | 4/1995 | Wayman et al. | 399/329 |

FOREIGN PATENT DOCUMENTS

| | | |
|---|---|---|
| 6-151681 | 8/1985 | Japan . |
| 4-125581 | 4/1992 | Japan . |
| 4-358190 | 12/1992 | Japan . |

*Primary Examiner*—Nestor R. Ramirez

*Attorney, Agent, or Firm*—Antonelli, Terry, Stout, & Kraus, LLP

[57] ABSTRACT

In a color electrophotographic apparatus, a belt fixing device which includes a pressure roller and a plurality of belt transport rollers for rotating a belt are provided for fixing unfixed toner. In the belt fixing device, a heating roller and a driving roller, which constitute the belt transport rollers, are always kept in contact with the pressure roller so that a fixing belt is curved in contact with the pressure roller, and after fused toner has been cooled, the driving roller applies pressure to the toner to separate the toner from the belt. According to this arrangement, a small-sized fixing device is achieved in which no silicone oil is needed and in which the running stability of sheets and the fixing belt is superior so that a high-quality fixed image can be obtained. A color electrophotographic apparatus using such a fixing device is also achieved.

21 Claims, 12 Drawing Sheets

ELECTROPHOTOGRAPHIC APPARATUS AND BELT FIXING DEVICE WITH NON-UNIFORM NIP PRESSURE

BACKGROUND OF THE INVENTION

The present invention relates to a fixing device for use in an image forming apparatus utilizing electrophotography, such as a copying machine or a printer.

Conventional thermal fixing devices used in color printers or color copying machines are generally divided into two types, represented by a belt fixing system including a pressure roller and a heating roller having a heater inside and an outside surface covered with an elastic material, and a roller fixing system. The present invention relates to the belt fixing type of system.

The belt fixing system is arranged to fuse toner on a recording medium by heating the toner via a belt, followed by sufficiently cooling the fused toner, and then separating the toner from the belt. The belt fixing system has the advantage that an offset phenomenon does not easily occur, because the toner fused to a recording sheet is separated from the belt after the toner has been sufficiently cooled and fixed to the sheet. The belt fixing system can be broadly divided into the following three types: one type in which fixation is effected by means of a pressure roller and one belt, as disclosed in Japanese Patent Laid-Open No. 273279/1992; another type in which fixation is effected by means of two pressure rollers and one belt, as disclosed in Japanese Patent Laid-Open Nos. 39057/1990 and 199170/1992; and a last type in which fixation is effected by passing a sheet through the gap between two belts, as disclosed in Japanese Patent Laid-Open Nos. 190870/1990 and 199169/1992.

However, each of these types of belt fixing system has a number of problems to be solved in regard to its arrangement.

To obtain a stable fixed image, it is necessary to solve the following two problems. The first problem resides in how to ensure the process of heating the toner, the process of cooling the toner and the process of separating the toner from the belt (hereinafter referred to simply as the heating-cooling-separating process) during the period in which a sheet, on which an unfixed toner image is formed, comes into contact with and is separated from the belt. The second problem resides in how to transport the belt and the sheet while maintaining them in stable contact before separating the belt from the sheet, without occurrence of a slack condition in or an out-of-plane deformation of the belt or the sheet.

The belt fixing system disclosed in Japanese Patent Laid-Open No. 273279/1992 is arranged to separate the sheet from the belt by using the rigidity of the sheet, so that after toner has been fused by heating, the adhesion of the toner to the belt must be sufficiently lowered by cooling the toner. According to the experiments of the present inventors, to separate toner fused at 120° C. from a belt using only the rigidity of a sheet, without causing an offset phenomenon, it was necessary to cool the belt during separation to a temperature range of approximately 60°–70° C., which is near the glass-transition point of the toner.

Accordingly, the above-described arrangement has the disadvantage that the size of the device increases because it is necessary to provide forced cooling means, such as a fan, and to ensure cooling over a certain distance to provide sufficient cooling by making the belt longer. The arrangement also has the problem that the power consumption of a heat source increases, because after the belt has been cooled by forced cooling and is separated from the toner, the belt must be again heated.

The belt fixing system disclosed in Japanese Patent Laid-Open No. 199170/1992 proposes a method of preventing occurrence of offset toner without forced cooling by removing toner from a belt by applying pressure to the toner, thereby facilitating the removal of the toner. However, since two independent pressure members are respectively present in a heating portion and a removing portion, immediately before or after a sheet, which has passed through the heating portion, enters the pressure portion of the removing portion, curls, slacks or wrinkles may occur in the sheet, with the result that a disturbed image may be recorded or a sheet jam may occur.

To cope with this problem, as proposed in Japanese Patent Laid-Open No. 190870/1990, there is employed a method of heating and cooling toner on a sheet with the sheet clamped between two belts, and wherein the toner is finally separated from the belts by applying pressure to the toner. In this method, since a sheet is transported while being clamped between two belts, no problem resulting from the behavior of the sheet occurs, but it is necessary to stably drive the opposed two belts without causing zigzag movement between them at the same time. Normally, if either one of the opposed two belts deviates, the other one undergoes an opposite force by reaction, so that the respective belts zigzag in opposite directions with respect to each other. Accordingly, the two opposed belts are extremely difficult to operate stably to transport the sheet, and a complicated device is needed for preventing zigzagging of the belts, as by inclining the belt-transporting roller shafts according to the zigzagging movement of the belts.

SUMMARY OF THE INVENTION

One object of the prevent invention is, therefore, to provide a small-sized belt fixing device which is capable of ensuring a heating-cooling-separating process for toner and of preventing occurrence of a toner offset phenomenon without using oil.

Another object of the present invention is to enable a belt and a sheet to be separated from each other in the state of being maintained in stable contact with each other without involving a slack condition or an out-of-plane deformation, thereby preventing an image degradation due to such slack condition or out-of-plane deformation.

To achieve the above objects, in a belt fixing device which comprises an endless fixing belt having a surface coated with a releasing agent, a plurality of belt transport rollers for rotatably supporting the fixing belt, a heat source for applying heat to a sheet, and a pressure roller which is resiliently mounted for pressing the sheet against the fixing belt, the plurality of belt transport rollers are disposed in pressure contact with an external surface of the pressure roller via the fixing belt, and the pressure between the pressure roller and one roller of the belt transport rollers, which is disposed on the upstream side in a direction of sheet transport, is larger than the pressure between the pressure roller and another belt transport roller disposed in contact with the pressure roller. The belt transport roller disposed downstream in the direction of sheet transport is a driving roller for rotationally driving the fixing belt.

In addition, the fixing belt and the pressure roller have a first contact portion in which toner adhering to the sheet is heated and fused by the heat source, a second contact portion in which the fused toner is cooled, and a third contact portion in which the fixing belt and the pressure roller are kept in contact with each other by a pressure greater than the pressure applied to the toner and the sheet in each of the first and second contact portions. The belt transport roller which forms the third contact portion with the pressure roller is the driving roller.

DESCRIPTION OF THE EMBODIMENTS

A color electrophotographic apparatus according to one embodiment of the present invention will be described with reference to FIGS. 1 to 3.

Figure 1:
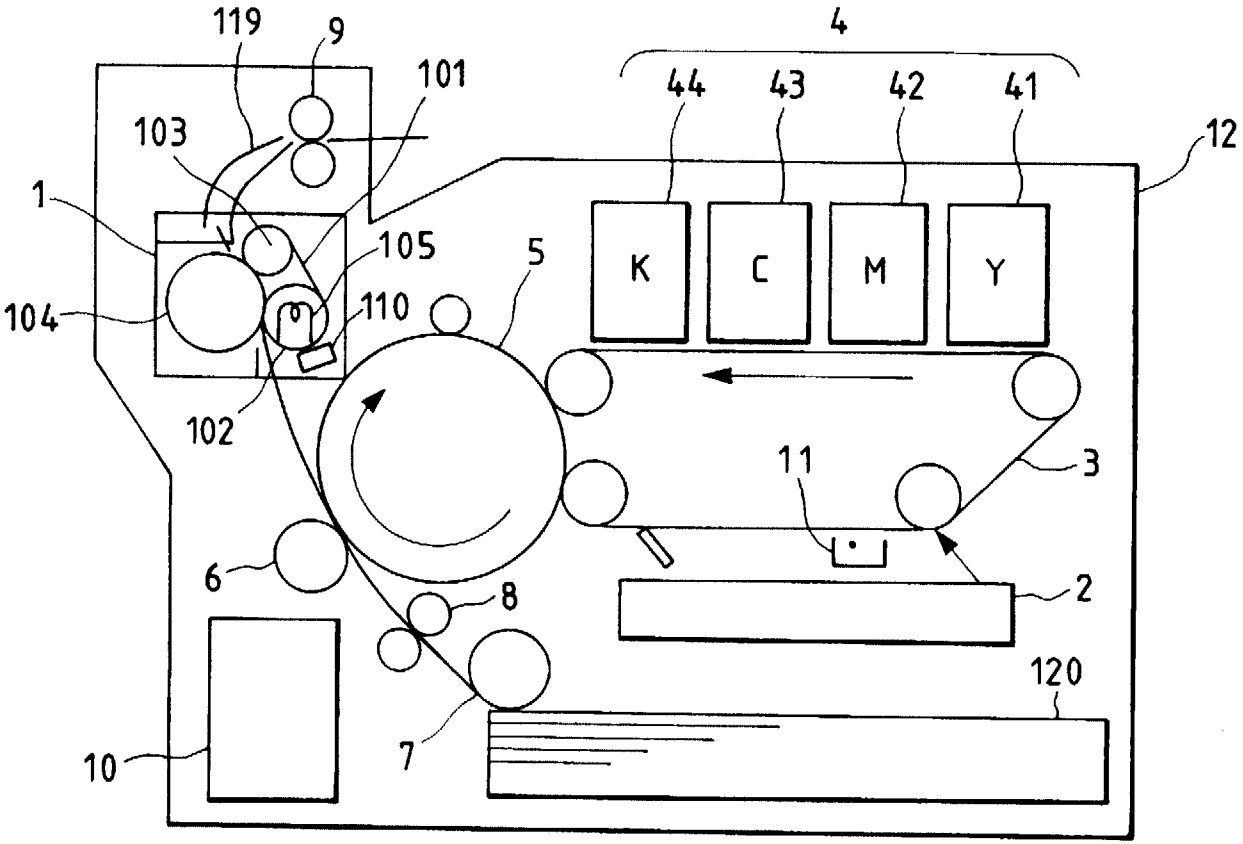
FIG. 1 is a cross-sectional diagram of the arrangement of a color electrophotographic apparatus according to one embodiment of the present invention.

FIG. 1 is a diagrammatic cross-sectional view of the construction of a color electrophotographic apparatus according to the present invention.

As shown in FIG. 1, a color electrophotographic apparatus 12 comprises a photosensitive belt 3 on which an electrostatic latent image is formed based on a print signal, an optical device 2 for forming an electrostatic latent image on the photosensitive belt 3, and a developing system 4 including a yellow (Y) developer 41, a magenta (M) developer 42, a cyan (C) developer 43 and a black (K) developer 44, which respectively develop images by supplying their toners to electrostatic latent images of the corresponding colors formed on the photosensitive belt 3. A transfer system includes a transfer drum 5 for transferring a color toner image to a sheet, the color toner image being formed on the transfer drum 5 by transferring the toner images formed on the photosensitive belt 3 to the transfer drum 5 on a color-by-color basis. A charger 11 is provided for uniformly charging the photosensitive belt 3, the charger 11 being positioned upstream of the position at which the electrostatic latent image is formed on the photosensitive belt 3 by the optical device 2, and a transfer roller 6 operates for pressing the sheet against the transfer drum 5 and transferring the color toner image to the sheet, the transfer roller 6 being opposed to the transfer drum 5 in such a manner as to clamp the sheet therebetween. A fixing device 1, which includes a fixing belt 101, a heating roller 102, a driving roller 103 and a pressure roller 104 is provided upstream of the transfer roller 6, in accordance with the present invention, and is maintained at a constant temperature by a heater 105 and a temperature sensor 110. A sheet transport system supplies sheets 120 and includes a sheet accommodating part in which sheets 120 are accommodated, a pickup roller 7 for taking the sheets 120 out of the sheet accommodating part on a sheet-by-sheet basis, register rollers 8 for correcting the position of a sheet 120 being transported, delivery rollers 9 and a sheet guide 119 for guiding the sheet 120 fed out of the fixing device 1 to the delivery rollers 9. A control part 10 is provided for controlling the aforesaid constituent elements. The transfer drum 5 electrostatically contacts the photosensitive belt 3, which is uniformly charged by the charger 11, the transfer drum being arranged to rotate in accordance with the rotation of the photosensitive belt 3.

Figure 2:
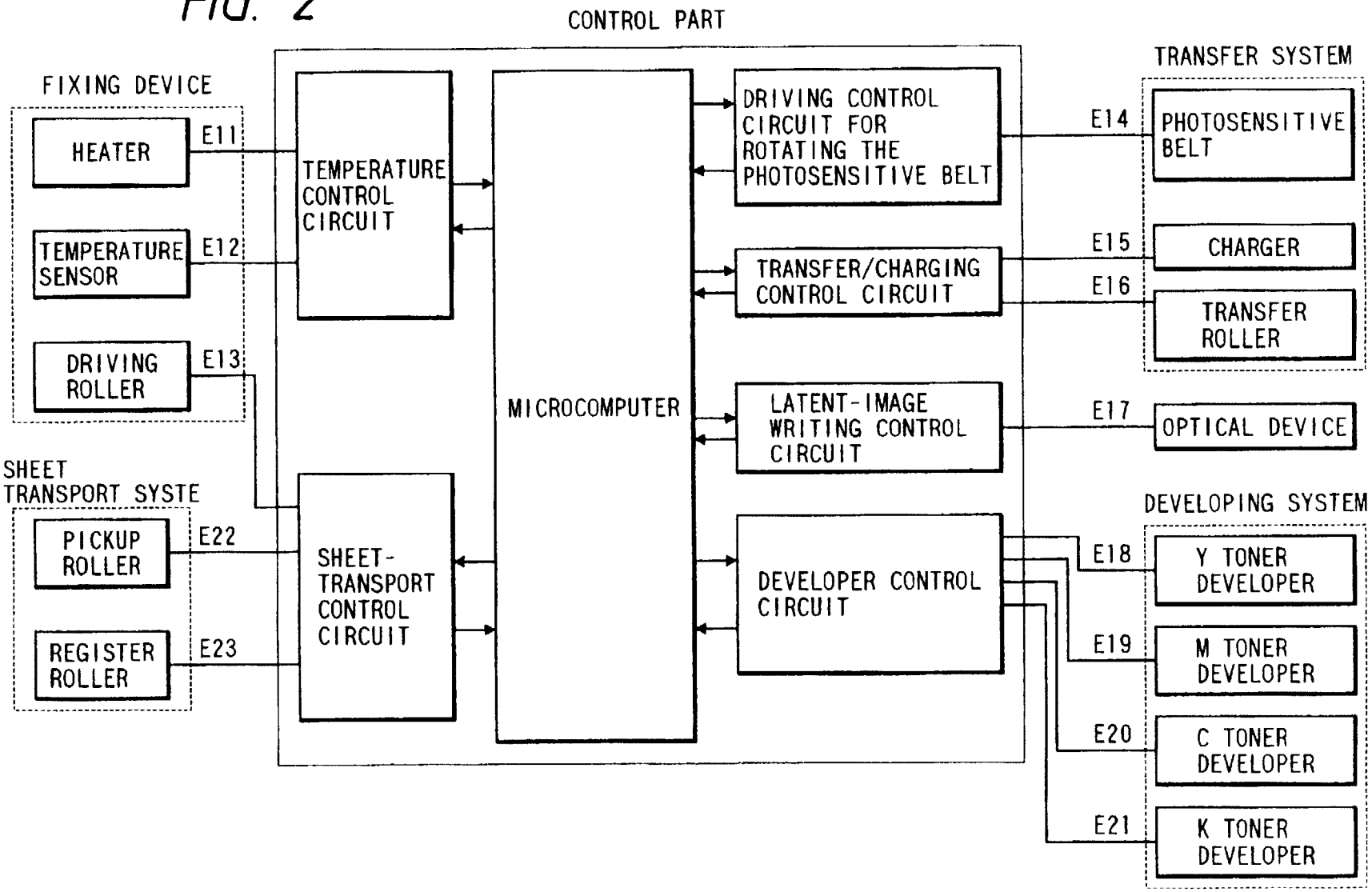
FIG. 2 is a block diagram showing the arrangement of the control part shown in FIG. 1.

FIG. 2 is a block diagram showing the control system for the color electrophotographic apparatus. The control part 10 includes a microcomputer and six control circuits which include a temperature control circuit for maintaining the fixing device 1 at a constant temperature, a sheet-transport control circuit for controlling the sheet transport system for transporting a sheet, a driving control circuit for rotating the photosensitive belt 3, a transfer/charging control circuit for charging the photosensitive belt 3 and for transferring a color toner image to a sheet, a latent-image writing control circuit for forming an electrostatic latent image on the photosensitive belt 3, and a developer control circuit for developing the electrostatic latent image on the photosensitive belt 3 using the toners. The respective control circuits receive signals from the microcomputer and operate the constituent elements of each of the fixing device 1, the sheet transport system, the transfer system and the developing system 4, using signals indicated at E11 to E23 in FIG. 2.

Figure 3:
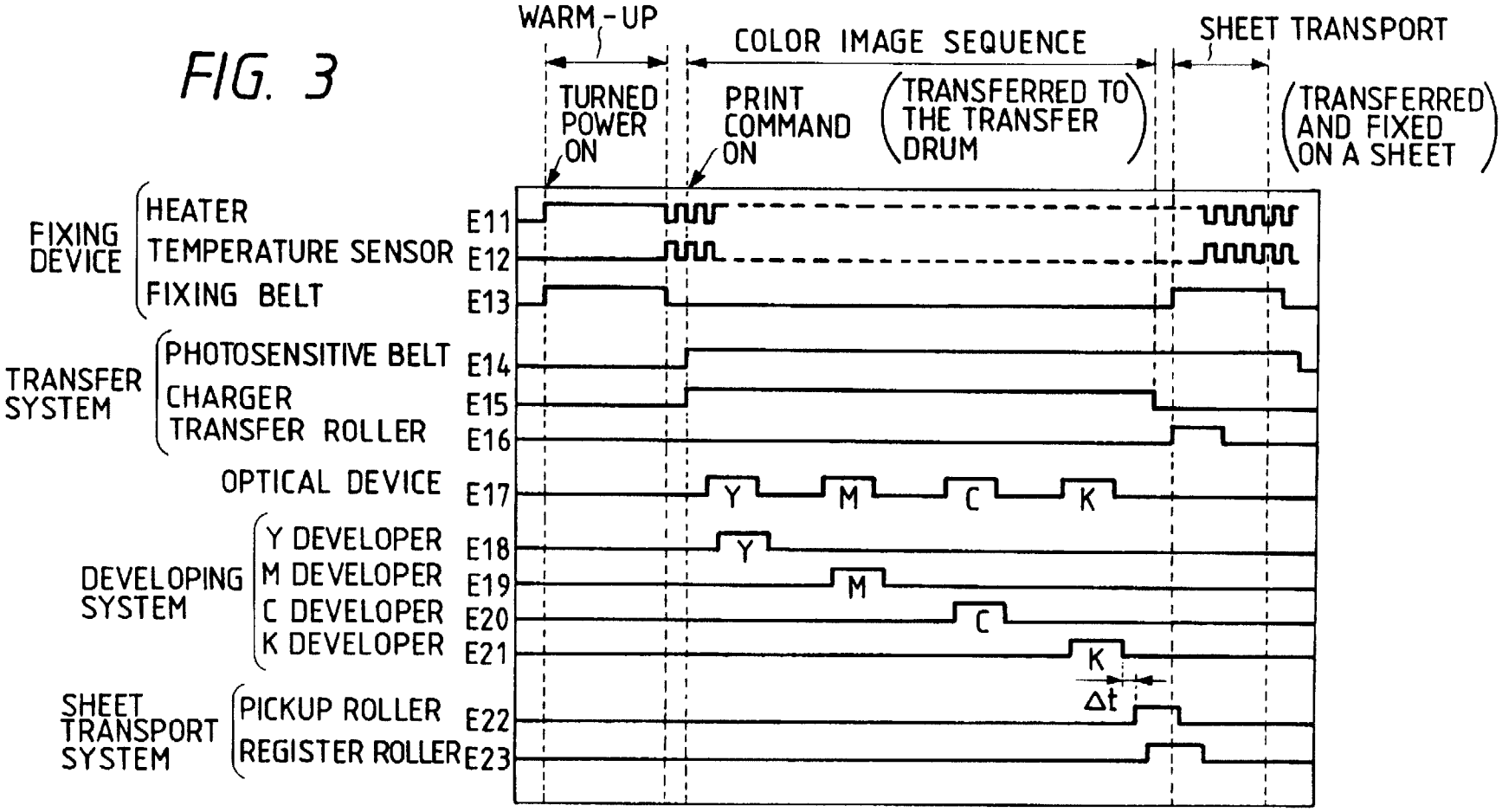
FIG. 3 is a timing chart aiding in describing the operational timing of each part shown in FIG. 1.

FIG. 3 is a timing chart showing the operation of each of the constituent elements of the color electrophotographic apparatus. The operation of the color electrophotographic apparatus according to the present invention will be described below.

When the power source of the color electrophotographic apparatus 12 is turned on, a heater 105 starts to generate heat so that the fixing belt 101 is heated to a certain constant temperature, in accordance with the signal E12 (LOW: ON, HIGH: OFF) of the temperature sensor 110, and the fixing belt 101 is rotated in accordance with the signal E13. After that, when the temperature sensor 110 detects that the fixing belt 101 has reached a certain constant temperature, the rotation of the fixing belt 101 is stopped and the warm-up of the fixing device 1 is completed.

Then, if a print command signal is entered, a color image is formed during the following sequence of operations.

First, the photosensitive belt 3 is rotated in accordance with the signal E14, and the charger 11 operates in accordance with the signal E15 so that the surface of the photosensitive belt 3 is uniformly charged. Then, the optical device 2 operates in accordance with the signal E17, and forms an electrostatic latent image for the color yellow (Y) on the photosensitive belt 3. Then, the Y developer 41 receives the signal E18 and causes a Y toner to be electrostatically attracted to this latent image, thereby forming a Y toner image.

After that, the Y toner image on the photosensitive belt 3 is transported to the portion where contact occurs between the photosensitive belt 3 and the transfer drum 5, which is based by the electrostatic attraction of the photosensitive belt 3 for the transfer drum 5, so that the image is transferred to the transfer drum 5 by the electrostatic attraction. The above-described operation is carried out for a magenta (M) toner in accordance with the signal E19, a cyan (C) toner in accordance with the signal E20, and a black (K) toner in accordance with the signal E21, whereby a color toner image in which the four colors are superposed on each other is formed on the transfer drum 5. At this point, one color-image forming sequence is completed. During this color-image forming sequence, the transfer roller 6 is not placed in contact with the transfer drum 5; however, when a color toner image is to be transferred from the transfer drum 5 to a sheet 120, the transfer roller 6 is moved into contact with the transfer drum 5 with the sheet 120 interposed therebetween.

In the meantime, one sheet 120 has been fed by the pickup roller 7 in a time period Δt after the development of the K toner image has been carried out, and the sheet 120 is transported to the transfer drum 5 while any skew in the fed sheet 120 is being corrected by the register rollers 8, which rotate in accordance with the signal E23, issued slightly later than the signal E22. Then, the color toner image formed by the above-described color-image forming sequence is transferred from the transfer roller 6 to the sheet 120, which thereafter is transported to the fixing device 1 maintained at a constant temperature. The unfixed color toners transferred to the sheet 120 are fused thereto by the application of heat and pressure by the fixing belt 101 and the pressure roller 104, and the fused color toners are cooled and fixed. After that, the sheet 120 is guided to a bent guide 119 and carried out of the electrophotographic apparatus by the delivery rollers 9.

Figure 15:
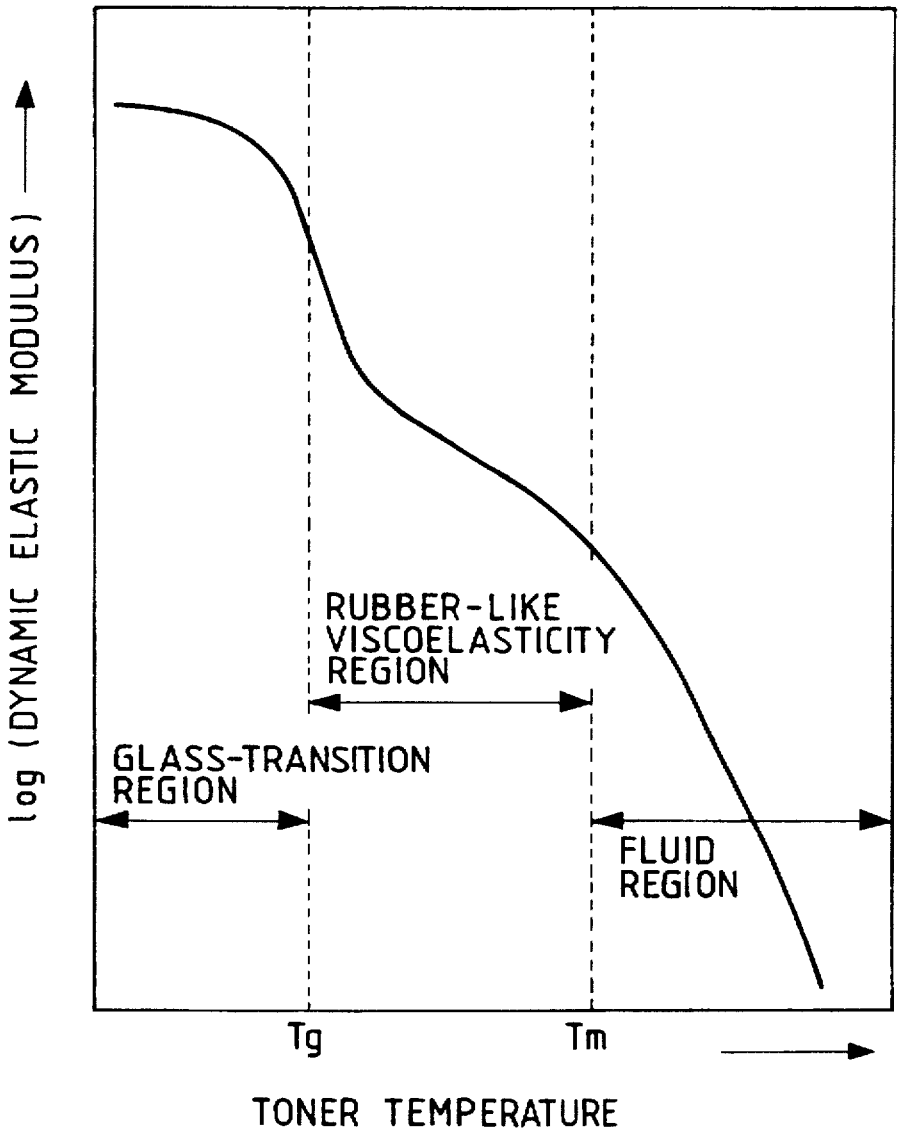
FIG. 15 is a graph showing the relationship between the dynamic elastic modulus and the temperature of toner.

Normally, the dynamic elasticity characteristics of toner vary with temperature, as shown in FIG. 15. Specifically, the elasticity decreases with an increase in temperature, and the dynamic elasticity characteristics are divided into three regions, i.e., a glass-transition region in which elastic behavior is dominant, a rubber-like viscoelasticity region in which viscosity and elasticity are mixed, and a fluid region in which viscous behavior is dominant. In the color electrophotographic apparatus, to improve the color development of color toner, the toner is fixed by being fully fused so that the toner reaches a fluid region above a softening temperature Tm.

The fixing device 1 according to the invention will be described below.

Figure 4B:
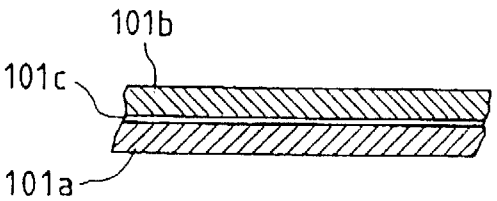
FIG. 4(*a*) is a cross-sectional view of one embodiment of the belt fixing device shown in FIG. 1 and FIG. 4(*b*) is a partial cross-section of the belt 101 therein.
Figure 4A:
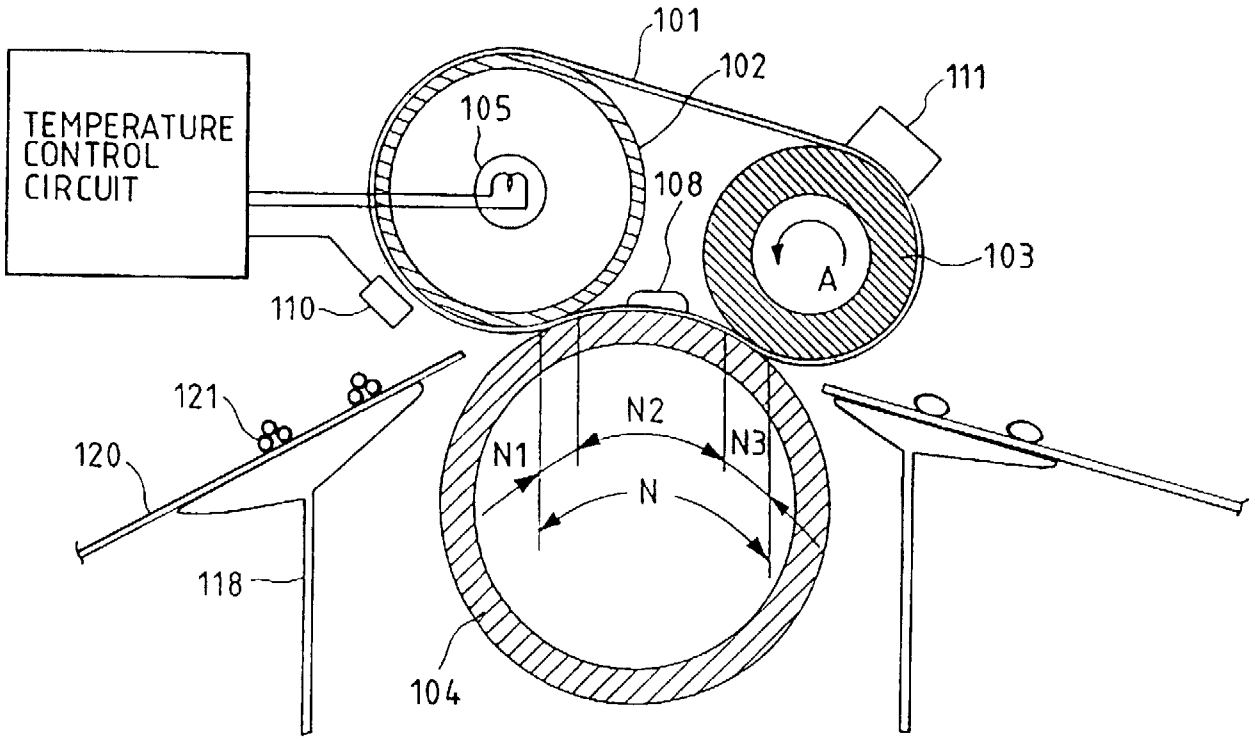

FIG. 4(*a*) is a cross-sectional view of the structure of the fixing device 1. The fixing device 1 includes a heating roller 102 and a driving roller 103, each of which serves as a belt transport roller for transporting the fixing belt 101, the heating roller 102 having a heater 105 disposed therein. The fixing belt 101 is disposed between the pressure roller 104 and each of these belt transport rollers, and so the pressure roller 104 is maintained in contact with both the heating roller 102 and the driving roller 103 via the fixing belt 101, thereby forming a belt contact portion N. This belt contact portion N is divided into a first contact portion N1 in which the pressure roller 104 is maintained in contact with the heating roller 102 via the fixing belt 101 owing to the elastic deformation of silicone rubber coatings formed around the respective surfaces of the driving roller 103 and the pressure roller 104, a second contact portion N2 in which the fixing belt 101 is wound around the external circumference of the pressure roller 104 owing to the tension of the fixing belt 101, and a third contact portion N3 in which the pressure roller 104 is maintained in contact with the driving roller 103 via the fixing belt 101. In the present embodiment, the pressure roller 104, the heating roller 102 and the driving roller 103 are 32 mm, 22 mm and 18 mm in roller diameter, respectively. The entire length of the fixing belt 101, which is wound around the rollers 102 and 103, is 110 mm.

A motor (not shown) is connected to the driving roller 103, and the driving roller 103 rotates in response to driving force of the motor in the direction of an arrow A.

The temperature sensor 110 is provided near the external surface of the fixing belt 101 at a position where the fixing belt 101 is curved in contact with the heating roller 102, and the temperature control circuit controls the heat generation of the heater 105 in response to a signal from the temperature sensor 110 so that the temperature of the fixing belt 101 can be kept constant. The sheet 120, which carries an unfixed toner 121, is guided into the belt contact portion N by a transport guide 118, and fixation of the toner is effected while the sheet 120 is being transported through the contact portion N while it is clamped between the pressure roller 104 and the fixing belt 101, which is heated to a constant temperature. Cleaning means 111 is placed in contact with the portion of the fixing belt 101 which follows the curve around the back side of the driving roller 103, at an appropriate pressure, whereby paper dust or fine residual toner particles on the fixing belt 101 are eliminated, and the rotational driving force of the driving roller 103 is efficiently transmitted to the fixing belt 101.

In the second contact portion N2, as cooling means 108, aluminum of good thermal conductivity is provided in contact with the surface of the fixing belt 101 which is opposite to the surface of contact between the fixing belt 101 and the pressure roller 104. This cooling means 108 also may be a metal of good thermal conductivity other than aluminum, for example, copper. Otherwise, air cooling using a fan may be adopted, but in the case of slow fixing speeds, since a sufficient cooling effect can be obtained from heat sinking through the rollers or natural heat radiation, additional cooling means of such type need not necessarily be provided. Incidentally, the fan may be of a type capable of blowing air in the axial direction of the rollers, for example, a sirocco fan.

Transport guides 118 are respectively provided upstream and downstream of the fixing device 1 in the sheet transport direction so that the sheet 120 can easily be inserted into and delivered from the fixing device 1.

As shown in the cross-sectional view of the fixing belt 101 of FIG. 4(*b*), the fixing belt 101 is a seamless belt formed by coating a surface of a nickel-electroformed belt 101*a* with silicone rubber 101*b*, with a primer layer 101*c* sandwiched therebetween. To suppress a possible reduction in strength due to heat, a belt which contained at least 90% nickel was employed successfully as the nickel-electroformed belt 101*a*.

It is preferable to make the fixing belt 101 as thin as possible so that the heat of the heating roller 102 can instantaneously be transmitted to the toner and the sheet. However, to prevent wrinkles, folds or cracks from occurring in the fixing belt 101, a certain amount of thickness is essential. As one example, the present embodiment successfully employed a belt formed by coating a 40-μm thick nickel-electroformed belt with silicone rubber of 30° Hs in rubber hardness and 100 μm in thickness.

Incidentally, the material of the fixing belt 101 may be a heat-resistant resin, such as polyimide or polyetherimide, instead of a nickel-electroformed belt, or a fluororesin, such as PTFE (polytetrafluoroethylene) or PFA (tetrafluoroethyleneperfluoroalkyl vinyl ether copolymer), may also be used instead of silicone rubber. However, if the nickel-electroformed belt is to be coated with a fluororesin, the nickel-electroformed belt needs to contain at least 97% nickel, so that a thermal degradation or a cracking of the nickel-electroformed belt can be prevented during a calcination process of 200° C. or more.

The principle and process of operation of the fixing device according to the invention will be described below with reference to FIGS. 5 and 6.

Figure 5:
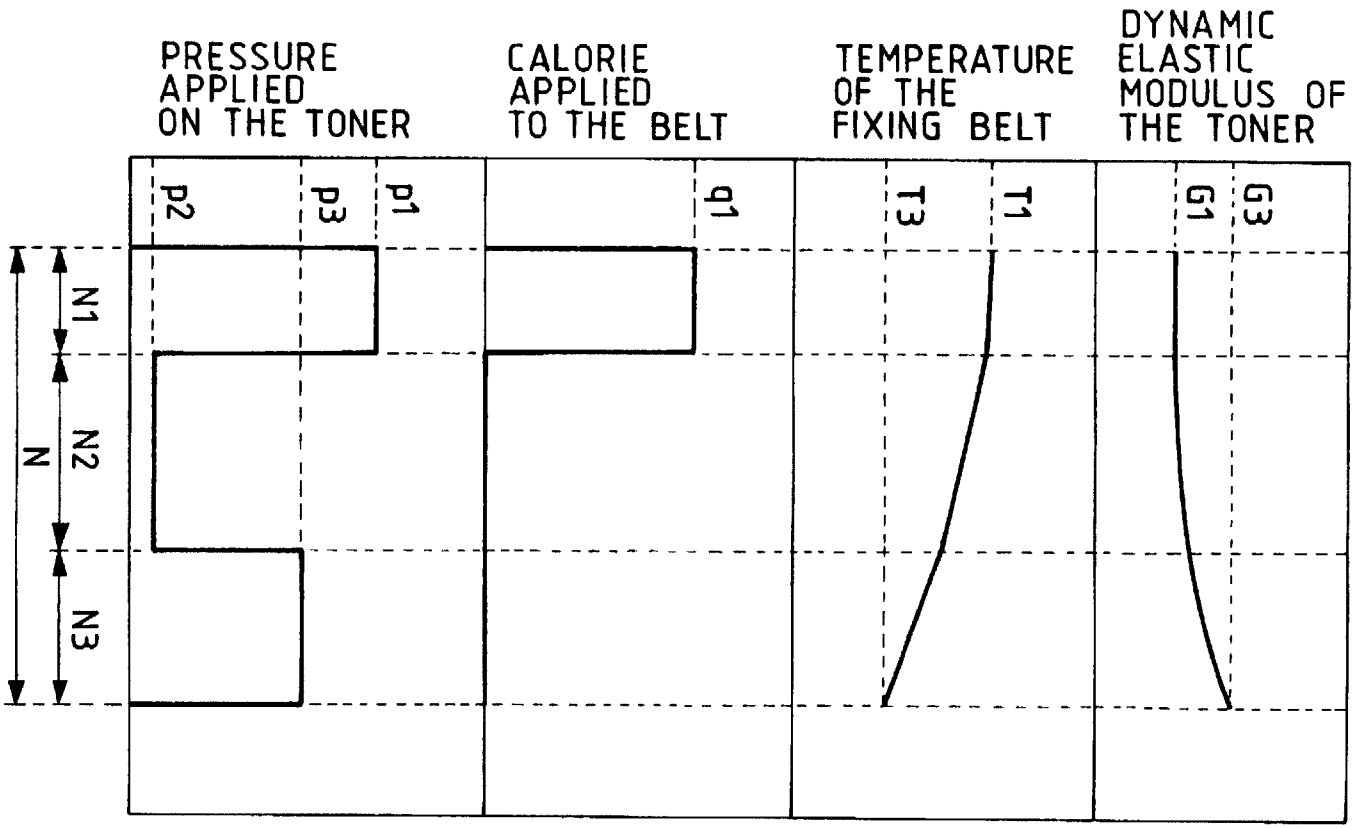
FIG. 5 is a graph showing variations of four physical quantities in each contact portion shown in FIG. 4(*a*)
Figure 6:
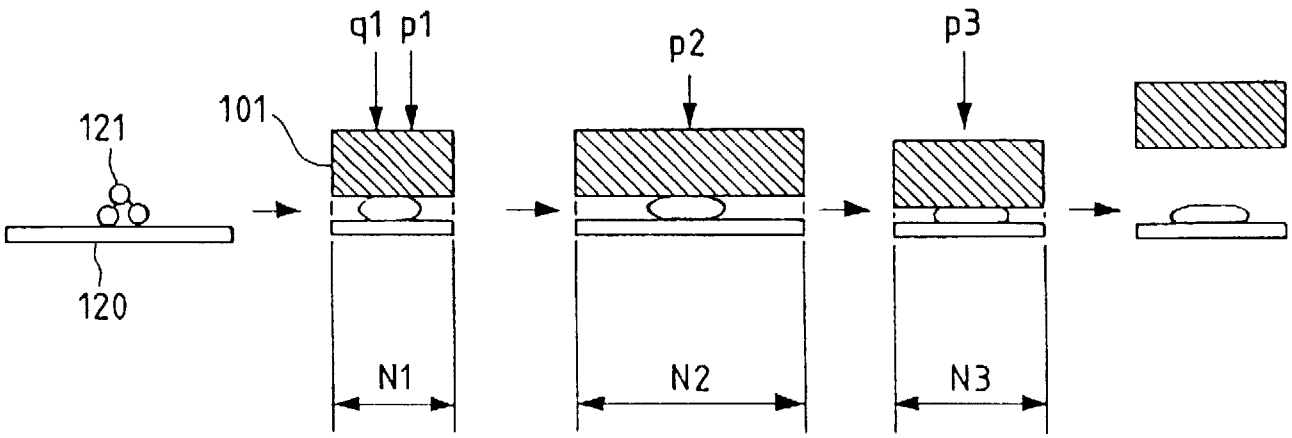
FIG. 6 is a process flow diagram showing the fixing process of the device shown in FIG. 4(*a*)

In FIG. 5, the horizontal axis represents the three contact portions N1, N2 and N3, and the vertical axis represents four physical quantities in each of those contact portions, i.e., the pressure applied to the toner, the quantity of heat applied to the fixing belt, the temperature of the fixing belt, and a variation in the dynamic elastic modulus of the toner. FIG. 6 is a conceptual diagram showing the process of fixing the unfixed toner 121 to the sheet 120 in each of the contact portions N1, N2 and N3.

Fixation is effected by heating the toner, then cooling the toner and then removing the toner from the fixing belt, while the toner is sequentially being passed through the three contact portions N1, N2 and N3.

First, when the unfixed toner 121 on the sheet 120 is transported to the first contact portion N1, the unfixed toner 121 is heated and fused by the application of a quantity of heat q1 produced by the heating roller 102, which is heated to a temperature T1 by the heater, and by the application of a pressure p1 by the pressure roller 104. Since the toner is heated to the temperature T1 above its softening point by the fixing belt 101, the temperature of the fixing belt 101 and the temperature of the surface of the toner which is in contact with the fixing belt 101 are considerably high, and the fluid region of the dynamic elastic modulus G1 of the toner is considerably low.

Then, the fused toner which is kept in contact with the fixing belt 101 is transported to the second contact portion N2 in which only a low pressure p2 generated by the tension of the fixing belt 101 is applied thereto. In the second contact portion N2, since there is no heat source, the temperature of the fixing belt 101 and the temperature of the surface of the toner which is in contact with the fixing belt 101 become lower. Then, when the toner is transported to the third contact portion N3, the temperature of the toner becomes far lower, since the heat of the fixing belt 101 is absorbed by the driving roller 103, and the toner is compressed by a pressure p3 by the driving roller 103 and the pressure roller 104. After that, the compressed toner is exposed to a tensile force due to a rapid removal of the toner from the fixing belt 101 at the exit of the third contact portion N3. However, since the dynamic elastic modulus G3 is in the rubber-like viscoelasticity region and the toner is in a semi-fused state, the toner cannot follow the path of the fixing belt, so that the toner can be removed from the fixing belt 101 without any toner adhering thereto.

Accordingly, in the present fixing device, after the toner has been fused by heating it to the softening temperature or above, it is important to cool the toner to the rubber-like viscoelasticity region and remove the toner by the application of pressure.

Figure 7:
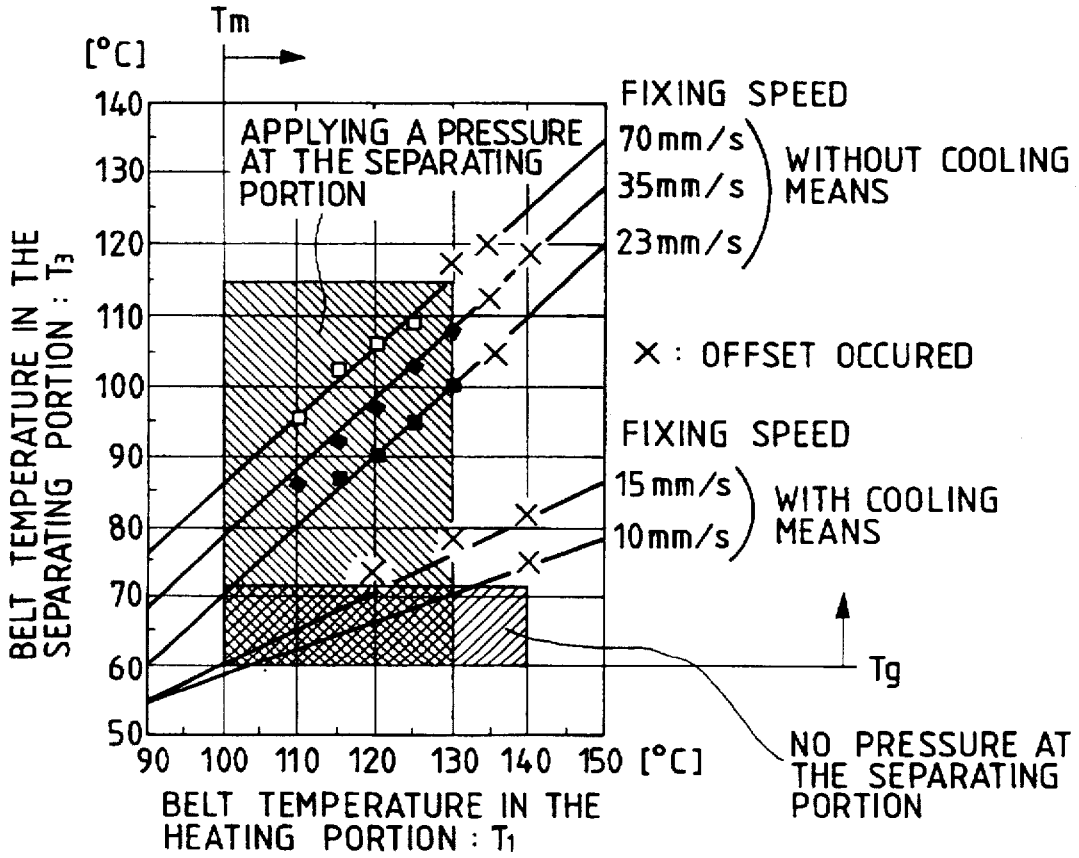
FIG. 7 is a graph showing the relationship between the belt temperature in the heating portion shown in FIG. 4(*a*) and the belt temperature in the separating portion shown in FIG. 4(*a*) with respect to the fixing speed.

FIG. 7 shows the result of examination of the cooling and pressure conditions of the toner in the fixing device of the present invention. Experiments were conducted by fixing an unfixed color toner image formed of color toners, each containing a polyester binder and having a glass-transition temperature Tg of 60° C. and a softening temperature Tm of 100° C. As the color toner image, a strip-shaped image having a width of 10 mm was formed by using color toners of yellow (Y), magenta (M), cyan (C), black (K), red (R), green (G) and blue (B).

The points shown in FIG. 7 are experimental points each of which indicates a belt temperature T1 in the heating portion and a belt temperature T3 in the separating portion at a different fixing speed. Each mark "x" indicates that an offset occurred. Incidentally, in the case of fixing speeds of 23–70 mm/s, the toner was separated from the fixing belt 101 by cooling the fixing belt 101 through natural heat radiation and by applying a pressure of 12 kPa to the toner, not by using the cooling means 108 shown in FIG. 4(*a*). In the case of fixing speeds of 10–15 mm/s, after the fixing belt 101 had been cooled by a fan, the toner was separated without applying a pressure.

As can be seen from the results of the experiments, the hatched range shown in FIG. 7 is the range in which good fixation can be effected without causing any offset, and by pressing and removing the toner, the occurrence of an offset is prevented even if the separation temperature is high. Specifically, if toner is to be removed by cooling alone without applying a pressure, it is necessary to forcedly cool the fixing belt to at least 70° C., while if toner is to be separated by the application of pressure, it suffices to cool the fixing belt to 115° C. or below, and no offset occurs even in the case of a temperature decrease of the fixing belt due to natural heat radiation.

On the other hand, if the belt temperature T1 of the heating portion is not higher than the softening temperature Tm of the toner, the color development of the toner is impaired and a defective fixation occurs. If the separation temperature is not lower than the glass-transition temperature Tg, the toner is consolidated in a state where it adheres to the fixing belt, so that a sheet is wound around the drive roller 103.

Incidentally, in the case of natural heat radiation, if the fixing speed is slow, an offset occurs even if the belt temperature T3 in the separating portion is not higher than 115° C., and the upper limit of the belt temperature T1 in the heating portion is approximately 130° C. This fact can be described in terms of the viscoelastic characteristics of toner, i.e., if the fixing speed is slow, the speed of separation of the toner from the fixing belt is slow, so that the toner can follow the separating speed by its tensile deformation due to the removal. Accordingly, if the fixing speed is increased and the separation temperature T3 is ensured by forced cooling, it is considered that the belt temperature T1 in the heating portion does not cause any offset.

As is evident from the above description, in the present fixing device, it is possible to effect a good fixation without causing any offset, by setting the belt temperature T1 in the heating portion to a temperature range not lower than the softening temperature Tm of toner and not higher than a temperature of 180° C. up to which no thermal degradation occurs in the fixing belt, and by setting the belt temperature T3 in the separating portion to a temperature range not lower than the glass-transition temperature Tg of toner and not higher than 115° C.

The method of supporting and driving the fixing belt will be described below.

Figure 8:
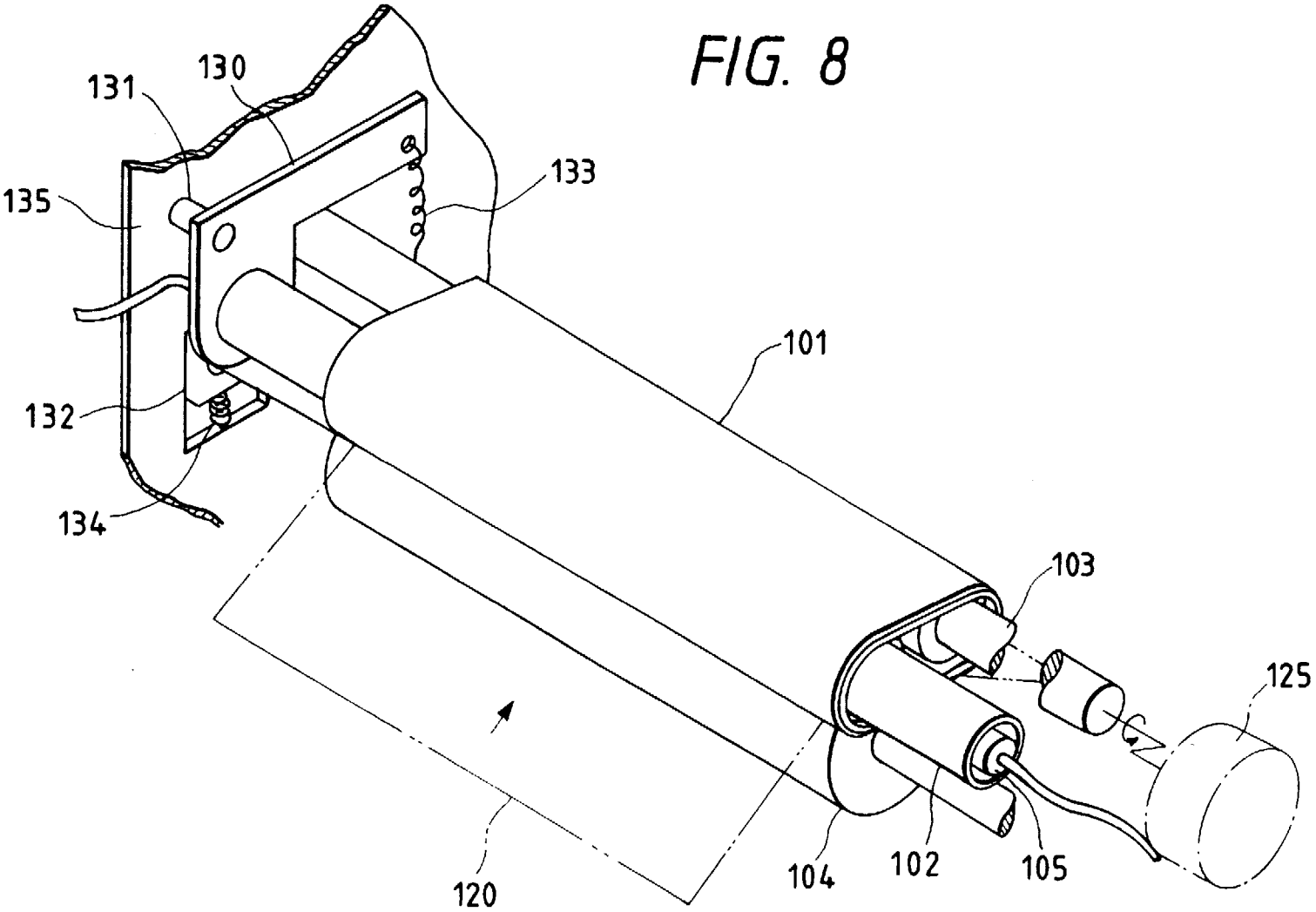
FIG. 8 is a perspective view of the device shown in FIG. 4(*a*)

FIG. 8 is a perspective view showing the present fixing device. The heating roller 102 is rotatably supported at each end by one end of an L-shaped arm 130 (only one shown) which is pivotally supported at a corner portion of its L shape by a pin 131, which is fixed to a side support plate 135. A tension spring 133 is secured to another end of the L-shaped arm 130, so that a tension acts on the fixing belt 101 due to the tensile force produced by the tension spring 133. Furthermore, the heating roller 102 is moved in the direction of the pressure roller 104 by the L-shaped arm 130, so that the contact portion N1 is formed as shown in FIG. 4(*a*). The pressure roller 104 is rotatably supported at each end by a holder 132 (only one shown) fitted in the side support plate 135, and is pressed against both the heating roller 102 and the driving roller 103 via the fixing belt 101 by the action of a compression spring 134. A driving motor 125 is connected to the driving roller 103 via a gear (not shown), and the fixing belt 101 and the sheet 120 are transported by the driving force of the driving motor 125 in the direction indicated by the arrow.

Since the fixing belt 101 is likely to be deformed by thermal expansion when it is heated, the fixing belt 101 or the sheet 120 may become wrinkled by an out-of-plane deformation in the first contact portion N1 and the third contact portion N3 (FIG. 4(*a*)) in each of which a large pressure is applied to the fixing belt 101 and the sheet 120. In addition, a deviation of the fixing belt 101 may be caused by an inclination of a roller shaft due to the backlash of the device. To provide for proper operation, it is necessary to prevent such out-of-plane deformation and any deviation of the fixing belt due to heat.

Figure 9:
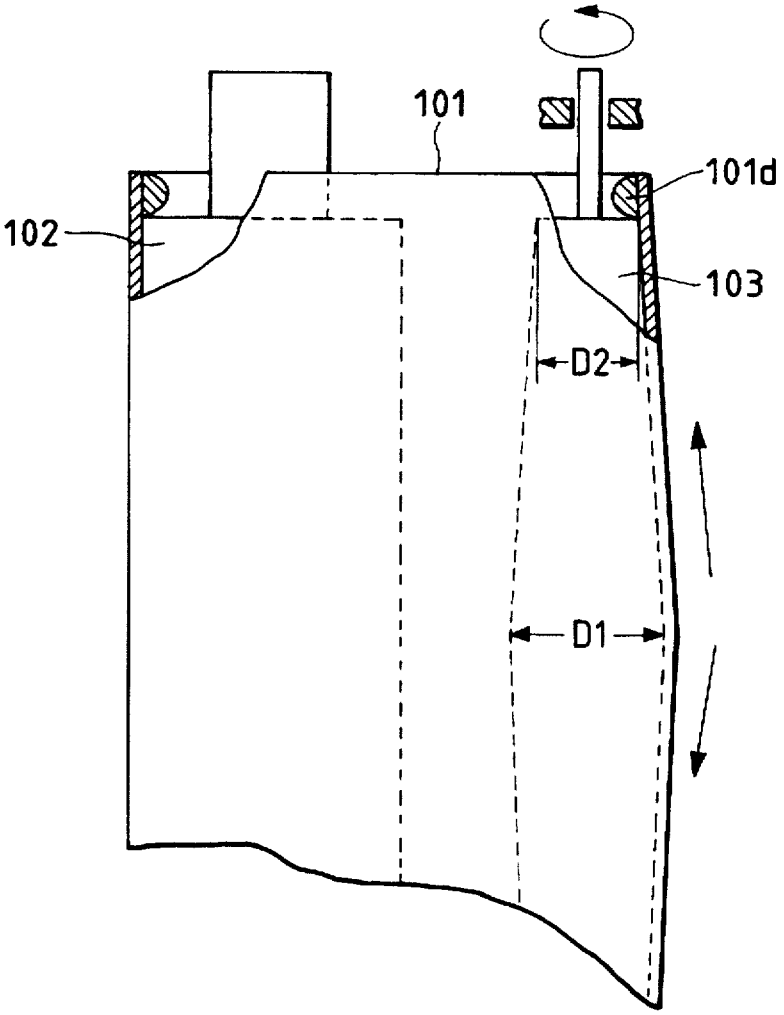
FIG. 9 is a top plan view showing the relationship between a fixing belt and a roller in the device shown in FIG. 4(*a*)

FIG. 9 is a top plan view showing the portion of the fixing belt 101 which passes between the heating roller 102 and the driving roller 103. The driving roller 103 has a crown shape in which an external diameter D1 of its central portion is larger than an external diameter D2 of its end portion, as shown with some exaggeration in FIG. 9. Accordingly, the deformation of the fixing belt 101 due to thermal expansion is expanded along the crown shape toward the opposite ends of the driving roller 103 to prevent an out-of-plane deformation of the fixing belt 101. Incidentally, if the amount of crowning (D1–D2) of the driving roller 103 is made large, the fixing belt 101 becomes unable to follow the shape of the crown, so that a large stress acts on only the central portion of the fixing belt 101 to cause a far greater out-of-plane deformation in the fixing belt 101. For this reason, it is necessary to set the amount or crowning to 500 μm.

Figure 10:
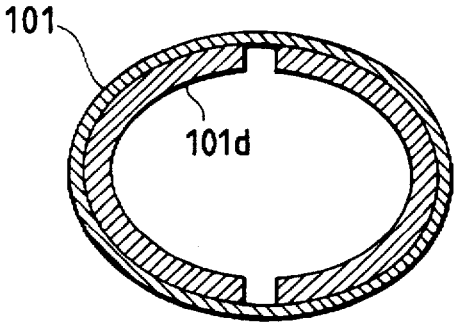
FIG. 10 is a cross-sectional view showing the shape of a rib of the fixing belt shown in FIG. 4(*a*)
Figure 11:
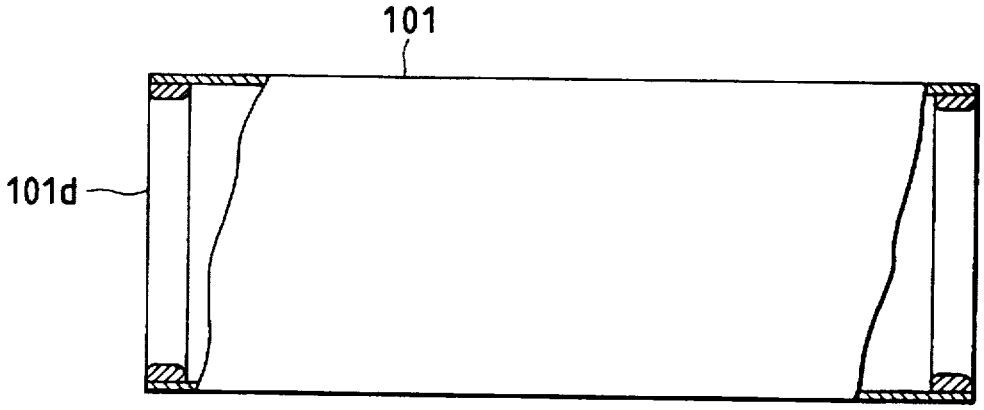
FIG. 11 is a cross-sectional view showing the opposite end portions of the fixing belt shown in FIG. 4(*a*)

In FIG. 9, reference numeral 101*d* denotes a rib bonded to each end of the fixing belt 101. The ribs 101*d* move in contact with the opposite end faces of the heating roller 102 and those of the driving roller 103 to prevent deviation of the fixing belt 101. The shape of each rib 101*d* is shown in FIGS. 10 and 11. Each of the ribs 101*d* includes two divided parts which are bonded to either of the opposite end positions of the inner surface of the fixing belt 101 so as to follow the deformation of the fixing belt 101.

Although in the present embodiment each of the ribs 101*d* is divided into two parts, the number of rib parts may be one or more, according to the circumferential length of the fixing belt 101. The ribs 101*d* also need a certain degree of elasticity. This is because forces for restricting the deviation of the fixing belt 101 by contact with the end faces of each roller act on the ribs and hard ribs cannot absorb such deviating forces, with the result that the ends of the fixing belt 101 are deformed and the fixing belt 101 itself is damaged. On the other hand, if the elasticity of the ribs 101*d* is small, the ribs 101*d* ride on the end portions of either roller and become unable to restrict the deviation of the fixing belt 101.

For this reason, it is appropriate for the hardness of each of the ribs 101*d* to be 40–70 degrees, which can be determined by the hardness test specified in JIS K6301. In the present embodiment, the ribs 101*d* are made of silicone rubber having a hardness of 50 degrees. Numerous fine notches are naturally produced during the manufacturing process along the edges of the fixing belt 101, so that as the fixing belt 101 is repeatedly transported, cracks ultimately produced from such fine notches. For this reason, the ribs 110*d* bonded to the opposite end portions of the fixing belt 101 have the effect of protecting the edges of the fixing belt 101 and of preventing cracks from occurring therein.

The relationship between the second contact portion N2 and the third contact portion N3 will be described below with reference to FIG. 12.

Figure 12:
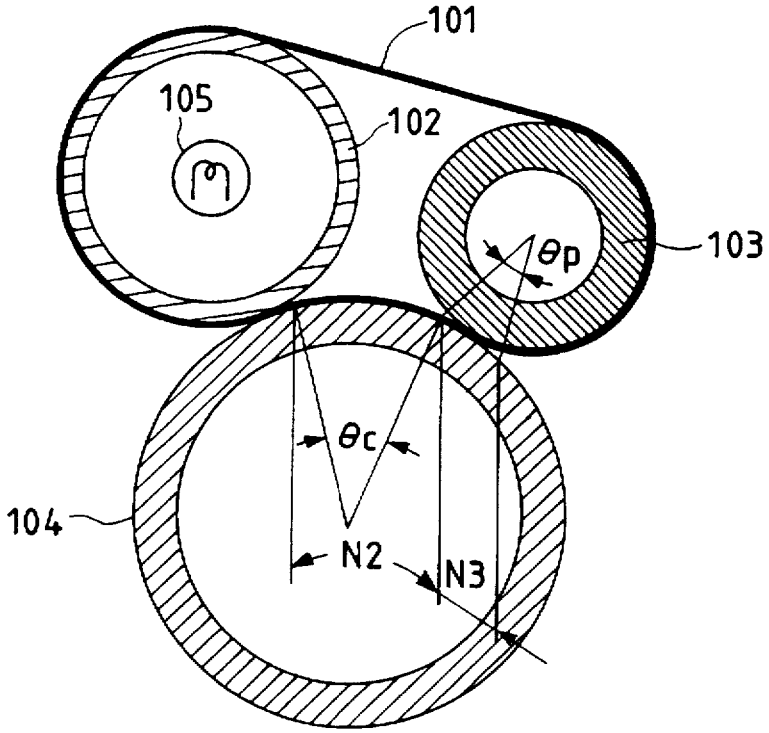
FIG. 12 is a cross-sectional view showing an angle $\Theta c$ of a second contact portion and an angle $\Theta p$ of a third contact portion in the fixing device shown in FIG. 4(*a*)

FIG. 12 shows an angle Θc which subtends the second contact portion N2 and having a vertex at the center of the pressure roller 104, and an angle Θp which subtends the third contact portion N3 and having a vertex at the center of the driving roller 103.

In the present fixing device, since the fused toner needs to be semi-fused by cooling in the second contact portion N2, it is desirable to make the distance of the second contact portion N2 as long as possible. If the second contact portion N2 is short, the toner will be sent to the third contact portion N3 in a fused state, so that an offset will occur during separation of the toner from the fixing belt 101. However, if the second contact portion N2 is made longer, the angle Θc subtended by the second contact portion N2 becomes larger, so that a curl which tends to coil around the pressure roller 104 easily occurs in the sheet 120.

In the color electrophotographic apparatus according the present embodiment, the sheet 120 is delivered to the outlet of the apparatus by the bent guide 119, as shown in FIG. 1. Thus, the curving direction of the curl which tends to coil around the pressure roller 104 becomes opposite to the curving direction of the bent guide 119, so that the transport of the sheet 120 to the bent guide 119 becomes unstable owing to the curl and a paper jam occurs.

For this reason, it is necessary to eliminate a sheet curl which tends to coil around the pressure roller 104, and this is accomplished according to the invention, by making the hardness of the elastic layer of the driving roller 103 equal to or greater than the hardness of the elastic layer of the pressure roller 104 and by forming a contact angle Θp in the third contact portion N3 on a side opposite to the side on which the angle Θc subtending the second contact portion N2 is located.

Figure 13:
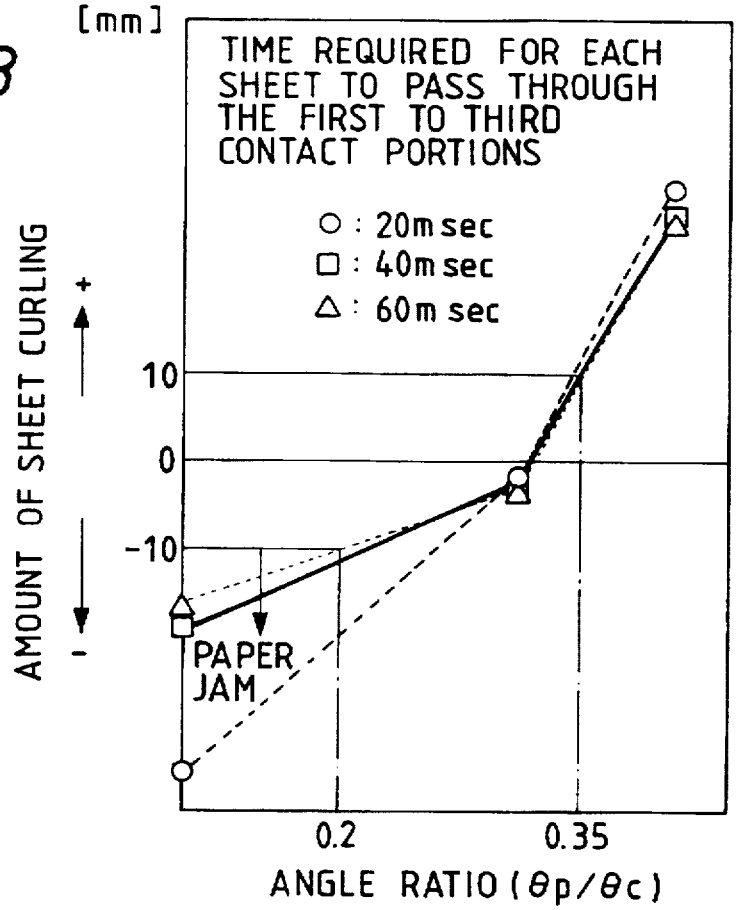
FIG. 13 is a graph showing the relationship between the amount of sheet curling and an angle ratio ($\Theta p/\Theta c$) of $\Theta p$ to $\Theta c$ shown in FIG. 12.

FIG. 13 shows the result of an experiment carried out to examine the relationship between the amount of sheet curling and an angle ratio (Θp/Θc) indicative of the relationship between the angle Θc subtending the second contact portion N2 and the angle Θp subtending the third contact portion N3. In this experiment, the time required for each sheet to pass through the first to third contact portions was changed. In FIG. 13, the horizontal axis represents the angle ratio (Θp/Θc), while the vertical axis represents the amount of sheet curling, and the direction in which the curl tends to coil around the pressure roller 104 is indicated by an negative arrow. As can be seen from FIG. 13, the amount of sheet curling depends on the angle ratio ($\Theta p/\Theta c$) of the second contact portion to the third contact portion, and if the angle ratio is $0.2 \leqq (\Theta p/\Theta c) \leqq 0.35$, the amount of sheet curling is within ±10 mm.

In the belt fixing device according to the present embodiment, for the above-described reason, a negative curl rather than a positive curl becomes a problem. If the amount of curling exceeds 10 mm, a sheet is wound around the presser roller 104 and a paper jam occurs. Therefore, if the present belt fixing device is to be employed in a color electrophotographic apparatus, the angle ratio ($\Theta p/\Theta c$) of the second contact portion to the third contact portion needs to be at least 0.2.

Incidentally, if a positive curl is to be prevented, $0.2 \leqq (\Theta p/\Theta c) \leqq 0.35$ is preferable. In addition, if the amount of curling is to be made approximately zero, it is preferable that $\Theta p/\Theta c$ be 0.35–0.33.

In the present embodiment, the fixing belt 101 is rotated by the two rollers 102 and 103. However, in order to improve the adhesion of the fixing belt 101 to each of the rollers 102 and 103 and enhance the belt transport force, the rollers which circumscribe the fixing belt 101 may be disposed on the side of the fixing belt 101 opposite to the pressure roller 104 in such a manner that the rollers press the fixing belt 101 from outside the fixing belt 101. Another embodiment of the present invention which adopts this concept is shown in FIG. 14.

Figure 14:
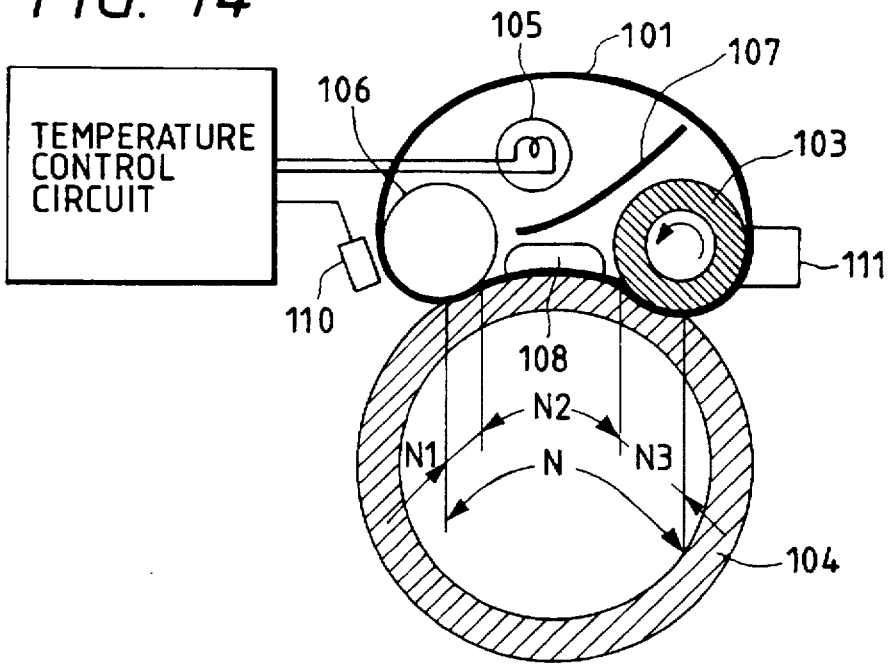
FIG. 14 is a cross-sectional view of another embodiment of the belt fixing device according to the present invention.

FIG. 14 is a cross-sectional view of a belt fixing device which may be substituted for the belt fixing device used in the above-described embodiment shown in FIG. 1. In the embodiment shown in FIG. 14, the other structures are similar to those described above.

The fixing belt 101 is rotationally transported in a tensionless manner by a transport roller 106 and the driving roller 103, the shafts of which are respectively fixed in position. The first contact portion N1, the second contact portion N2 and the third contact portion N3 are formed with the pressure roller 104, as shown in FIG. 14. The heater 105, a shield plate 107 and the cooling means 108 are disposed inside the fixing belt 101. The heater 105, which is now outside of the roller, heats the fixing belt 101 and the transport roller 106 by radiation so that the fixing belt 101 can be kept at a constant temperature in accordance with the output of the temperature sensor 110.

The shield plate 107 shields the second contact portion N2, the cooling means 108 and the driving roller 103 against the heat radiated from the heater 105. The cooling means 108 comes into contact with the fixing belt 101 in the second contact portion N2 to prevent the fixing belt 101 from slacking with respect to the pressure roller 104, and also cools the fixing belt 101 by absorbing the heat of the fixing belt 101.

The cleaning means Ill presses the fixing belt 101 against the driving roller 103 and eliminates paper dust and fine residual toner particles from the fixing belt 101. According to the present embodiment, since the fixing belt 101 is heated by both a direct heating using the heater 105 and an indirect heating using the transport roller 106, the fixing belt 101 can be sufficiently heated even in the case of fast fixing speeds. Accordingly, the fixing speed can be made fast compared to the color electrophotographic apparatus of the previous-described embodiment.

Although in the present embodiment no tension is applied to the fixing belt 101, another transport roller may also be disposed to inscribe the portion of the fixing belt 101 which extends from the driving roller 103 to the transport roller 106 in the belt rotating direction, to apply tension to the fixing belt 101. According to this arrangement, the tension can be securely applied to the fixing belt 101 so that transfer performance is improved to a further extent. In this case, if the added transport roller is disposed on the side of the shielding plate 107 opposite to the driving roller 103, the added transport roller is also heated, so that even in the case of fast fixing speeds, the fixing belt 101 can be heated to a further sufficient extent by the heat accumulated in the added transport roller.

According to the present invention, the heating-cooling-separating process for toner can be ensured by means of a simple arrangement using a small number of constituent components. Since the three contact portions are continuously formed along the circumference of one pressure roller, sheets can be stably transported.

In addition, sheets can be prevented from coiling around the pressure roller by setting to a predetermined value the ratio of the angle $\Theta c$ which subtends the second contact portion to the angle $\Theta p$ which subtends the third contact portion.

In addition, the pressure roller is provided with a mechanism for imparting tension to the fixing belt and the fixing belt is rotationally driven by a driving roller having a crown shape in which the external diameter of the central portion is larger than the external diameter of each of the opposite end portions. Therefore, an out-of-plane deformation of the fixing belt due to heat can be prevented and stable running of the fixing belt can be realized.

Accordingly, in accordance with the present invention, it is possible to ensure the heating-cooling-separating process for toner by means of a simple arrangement using a small number of constituent components, and it is also possible to easily achieve stable running of sheets and the fixing belt without using silicone oil, for example, whereby it is possible to provide a small belt fixing device free from toner offset.

In addition, a high-image-quality color electrophotographic apparatus can be provided by using the belt fixing device.

What is claimed is:

1. A belt fixing device comprising:

an endless fixing belt;

a plurality of belt transport rollers for rotatably supporting said fixing belt;

a heat source for applying heat to a sheet on which an image is to be fixed, said heat source being provided inside one belt transport roller of said plurality of belt transport rollers, said one belt transport roller being disposed at a sheet entrance of the belt fixing device; and a pressure roller mounted for pressing said sheet against said fixing belt, wherein said belt transport rollers are disposed in contact with an external circumference of said pressure roller with said fixing belt being interposed therebetween, and a pressure between said pressure roller and said one belt transport roller is larger than a pressure between said pressure roller and another belt transport roller which is disposed downstream of said one belt transport roller in a direction of sheet transport.

2. A belt fixing device according to claim 1, wherein said another belt transport roller which is disposed downstream in the direction of sheet transport is a driving roller for rotationally driving said fixing belt.

3. A belt fixing device according to claim 1, wherein said another belt transport roller is an unheated belt transport roller.

4. A belt fixing device comprising:

an endless fixing belt;

a plurality of belt transport rollers for rotatably supporting said fixing belt;

a heat source for applying heat to a sheet on which an image is to be fixed; and a pressure roller resiliently mounted for pressing said sheet against said fixing belt, wherein the area of contact between said fixing belt and said pressure roller includes, sequentially in a direction of sheet transport:

a first contact portion in which toner on the sheet is heated and fused by said heat source;

a second contact portion in which the fused toner is cooled; and a third contact portion in which said fixing belt and said pressure roller are kept in contact with each other;

wherein a pressure in said first contact portion is greater than a pressure applied to the toner and the sheet in each of said second and third contact portions.

5. A belt fixing device according to claim 4, wherein a belt transport roller which is kept in contact with said pressure roller via said fixing belt in said third contact portion is a driving roller for rotationally driving said fixing belt.

6. A belt fixing device according to claim 5, wherein heat source is provided within a belt transport roller which forms said first contact portion.

7. A belt fixing device according to claim 6, wherein an angle ratio ($\Theta p/\Theta c$) of an angle $\Theta c$ subtending said second contact portion and having an apex at the center of said pressure roller to an angle $\Theta p$ subtending said third contact portion and having an apex at the center of said driving roller is 0.2 to 0.35.

8. A belt fixing device according to claim 4, wherein said second contact portion is arranged so that the temperature of the toner in a toner separating part of said third contact portion is not less than a glass-transition point of the toner and not greater than the glass-transition point plus 15° C.

9. A belt fixing device according to claim 4, wherein the temperature of said fixing belt in said first contact portion is not less than a softening temperature of the toner and not greater than 180° C.

10. A belt fixing device according to claim 4, wherein cooling means is in contact with said fixing belt on a side thereof opposite to said pressure roller in the said second contact portion.

11. A belt fixing device according to claim 4, wherein air blowing means is provided for cooling said fixing belt on a side thereof opposite to said pressure roller in said second contact portion.

12. A belt fixing device comprising:

an endless fixing belt;

a plurality of belt transport rollers for rotatably supporting said fixing belt;

a heat source for applying heat to a sheet on which an image is to be fixed; and a pressure roller mounted for pressing the sheet against said fixing belt, wherein the area of contact between said fixing belt and said pressure roller includes, sequentially in the direction of sheet transport:

a first contact portion in which toner on the sheet is heated and fused by said heat source;

a second contact portion in which the fused toner is cooled; and a third contact portion in which said fixing belt and said pressure roller are kept in contact with each other;

wherein a pressure in said first contact portion is greater than a pressure applied to the toner and the sheet in each of said second and third contact portions; and wherein said fixing belt contains at least 90% nickel, and a sheet-contact surface of said fixing belt is coated with silicone rubber.

13. A belt fixing device according to claim 12, wherein an angle ratio ($\Theta p/\Theta c$) of an angle $\Theta c$ subtending said second contact portion and having an apex at the center of said pressure roller to an angle $\Theta p$ subtending said third contact portion and having an apex at the center of said belt transport roller in said third contact portion is 0.2 to 0.35.

14. A belt fixing device according to claim 12, wherein a belt transport roller which forms said third contact portion with said pressure roller has a crown shape in which the external size of a lengthwise central portion of said belt transport roller is greater than that of each of opposite end portions thereof.

15. A belt fixing device according to claim 13, wherein a cleaning member for cleaning a surface of said fixing belt is provided on a fixing-belt driving portion of said belt transport roller which forms said third contact portion with said pressure roller.

16. A belt fixing device according to claim 13, wherein a mechanism for imparting tension to said fixing belt is provided on said belt transport roller which is kept in contact with said pressure roller via said fixing belt and forms said first contact portion with said pressure roller.

17. A belt fixing device according to claim 13, wherein a rib having elasticity is provided on at least one edge along an inner surface of said fixing belt.

18. An electrophotographic apparatus including a photosensitive member, an exposure device for projecting light corresponding to image information onto said photosensitive member to form an electrostatic latent image thereon, a plurality of developers for developing the electrostatic latent image by employing toners corresponding to colors of the electrostatic latent image, a transfer device for transferring a developed toner image to a sheet, and a fixing device through which said sheet is passed for fixing the toner to the sheet, said fixing device comprising:

an endless fixing belt;

a plurality of belt transport rollers for rotatably supporting said fixing belt;

a heat source for applying heat to the sheet, said heat source being provided inside one belt transport roller of said plurality of belt transport rollers, said one belt transport roller being disposed at a sheet entrance of the belt fixing device; and a pressure roller mounted for pressing the sheet against said fixing belt, wherein said belt transport rollers are disposed in contact with an external circumference of said pressure roller with said fixing belt being interposed, and a pressure between said pressure roller and said one belt transport roller is larger than a pressure between said pressure roller and another belt transport roller which is disposed downstream of said one belt transport roller in a direction of sheet transport.

19. An electrophotographic apparatus according to claim 18, wherein the area of contact between said fixing belt and said pressure roller includes, sequentially in the direction of sheet transport:

a first contact portion in which toner on the sheet is heated and fused by said heat source;

a second contact portion in which the fused toner is cooled; and a third contact portion in which said fixing belt and said pressure roller are kept in contact with each other;

wherein a pressure in said first contact portion is greater than a pressure applied to the toner and the sheet in each of said second and third contact portions.

20. An electrophotographic apparatus according to claim 19, wherein an angle ratio ($\Theta p/\Theta c$) of an angle $\Theta c$ subtending said second contact portion and having an apex at the center of said pressure roller to an angle $\Theta p$ subtending said third contact portion and having an apex at the center of said belt transport roller is 0.2 to 0.35.

21. An electrophotographic apparatus according to claim 18, wherein said another belt transport roller is an unheated belt transport roller.

* * * * *